US009523273B2

(12) United States Patent
Mandal

(10) Patent No.: US 9,523,273 B2
(45) Date of Patent: Dec. 20, 2016

(54) ACOUSTIC MONITORING OF WELL STRUCTURES

(71) Applicant: Halliburton Energy Services, Inc., Houston, TX (US)

(72) Inventor: Batakrishna Mandal, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/348,313

(22) PCT Filed: Jun. 19, 2013

(86) PCT No.: PCT/US2013/046621
§ 371 (c)(1),
(2) Date: Mar. 28, 2014

(87) PCT Pub. No.: WO2014/204456
PCT Pub. Date: Dec. 24, 2014

(65) Prior Publication Data

US 2015/0085611 A1 Mar. 26, 2015

(51) Int. Cl.
*E21B 47/16* (2006.01)
*E21B 47/00* (2012.01)

(52) U.S. Cl.
CPC ..... *E21B 47/16* (2013.01); *E21B 47/0005* (2013.01)

(58) Field of Classification Search
CPC ..... E21B 47/16; E21B 47/12; E21B 47/122; G01V 11/002; G01V 1/42
USPC ..... 367/82
See application file for complete search history.

(56) References Cited

U.S. PATENT DOCUMENTS

| | | | |
|---|---|---|---|
| 2,825,044 | A | 2/1958 | Peterson |
| 3,292,146 | A | 12/1966 | Dewan |
| 3,485,317 | A | 12/1969 | Patel |
| 3,618,001 | A | 11/1971 | Zill et al. |
| 3,732,947 | A | 5/1973 | Moran et al. |
| 3,747,702 | A | 7/1973 | Beil |
| 4,131,875 | A | 12/1978 | Ingram |
| 4,255,798 | A | 3/1981 | Havira |
| 4,495,606 | A | 1/1985 | Smith |
| 4,703,427 | A | 10/1987 | Catala et al. |
| 4,916,648 | A | 4/1990 | Gard |

(Continued)

OTHER PUBLICATIONS

International Search Report and Written Opinion of the International Searching Authority issued in International Application No. PCT/US2013/046621 on Mar. 13, 2014; 10 pages.

(Continued)

*Primary Examiner* — Omer S Khan
(74) *Attorney, Agent, or Firm* — Benjamin Fite; Parker Justiss, P.C.

(57) ABSTRACT

An embodiment of a monitoring system for inspecting underground well structures includes a transmitter, a receiver, a processing module, and a power supply. The monitoring system is used to monitor pipe casings and structures surrounding the exterior of the pipe casings of a well. During operation, the transmitter directs time dependent energy radially towards a portion of a pipe casing, and the receiver measures energy that is returns to the system. The processing module amplifies, digitizes, and analyses the measurements of energy to produce monitoring information regarding the well structures.

14 Claims, 10 Drawing Sheets

(56) References Cited

U.S. PATENT DOCUMENTS

| | | | | |
|---|---|---|---|---|
| 5,051,962 | A | 9/1991 | Eaton | |
| 5,763,773 | A | 6/1998 | Birchak et al. | |
| 5,874,676 | A | 2/1999 | Maki, Jr. | |
| 6,014,609 | A | 1/2000 | McCoy | |
| 6,018,496 | A | 1/2000 | Stanke et al. | |
| 6,041,861 | A | 3/2000 | Mandal et al. | |
| 7,085,194 | B2 | 8/2006 | Garcia-Osuna et al. | |
| 7,755,973 | B2 | 7/2010 | Tello | |
| 8,270,250 | B2 | 9/2012 | Bonavides et al. | |
| 8,339,276 | B2 | 12/2012 | Mandal et al. | |
| 2007/0070809 | A1 | 3/2007 | Hurst et al. | |
| 2010/0061183 | A1 | 3/2010 | Mandal et al. | |
| 2013/0072799 | A1* | 3/2013 | Sato | A61B 8/14 600/447 |

OTHER PUBLICATIONS

Tenoudji et al., "Ultrasonic Tomography Application to the Visualization of Air Flow," IEEE Ultrasonics Symposium, 2004, 10 pages.

* cited by examiner

ACOUSTIC MONITORING OF WELL STRUCTURES

TECHNICAL FIELD

This disclosure relates to the acoustic monitoring of well structures, and more particularly to techniques for amplifying acoustic measurement signals obtained within a well structure.

BACKGROUND

Wells are commonly used to access regions below the earth's surface and to acquire materials from these regions, for instance during the location and extraction of petroleum oil hydrocarbons from an underground location. The construction of wells typically includes drilling a borehole and constructing a pipe structure within the borehole. Upon completion, the pipe structure provides access to the underground locations and allows for the transport of materials to the surface.

During the construction and operation of a well, various monitoring systems may be used to evaluate the integrity of the well's underground structures. For example, acoustic monitoring systems may be used to inspect a pipe casing and its surrounding cement support structure. These systems may be placed within the pipe casing and lowered through the wellbore, and generally include a transmitter that directs acoustic energy towards the casing, and a receiver that detects acoustic energy reflected from the casing and from the various materials beyond. Based on the measured reflections, the monitoring system provides information regarding the casing and its surrounding environment.

DESCRIPTION OF DRAWINGS

Like reference symbols in the various drawings indicate like elements.

DETAILED DESCRIPTION

As a pipe casing is typically a high contrast medium relative to its surroundings, energy from a monitoring system that is reflected from the pipe casing is often significantly stronger than the energy reflected from structures beyond the pipe casing. As such, in order to properly inspect both the pipe casing and the structures beyond, an acquisition system with a broad dynamic range is essential. However, this is problematic due to the lack of high dynamic range high frequency signal amplification devices that are suitable for the harsh environments commonly seen during oil exploration.

Figure 1:
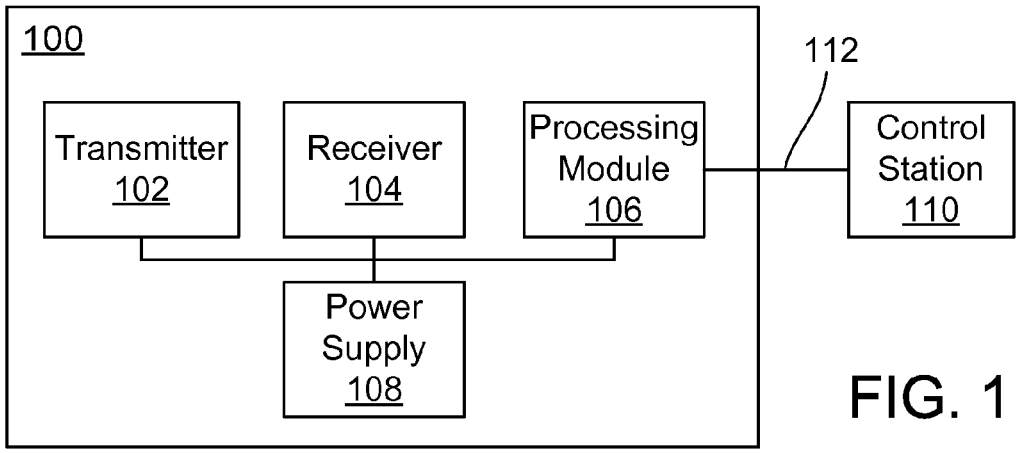
FIG. 1 is a block diagram of a monitoring system for inspecting underground well structures.

Referring to FIG. 1, an embodiment of a monitoring system 100 for inspecting underground well structures includes a transmitter 102, a receiver 104, a processing module 106, and a power supply 108. Processing module 106 is connected to an external control station 110 through a signal connector 112. As described in detail below, monitoring system 100 is used to monitor pipe casings and structures surrounding the exterior of the pipe casings of a well, such as cement support structures and surrounding rock. Monitoring system 100 may be used in conjunction with measurement while drilling (MWD) methods, logging while drilling (LWD) methods, coiled tubing drilling methods, and wireline methods, such that an operator may operate monitoring system 100 during the construction or operation of a well.

Figure 2:
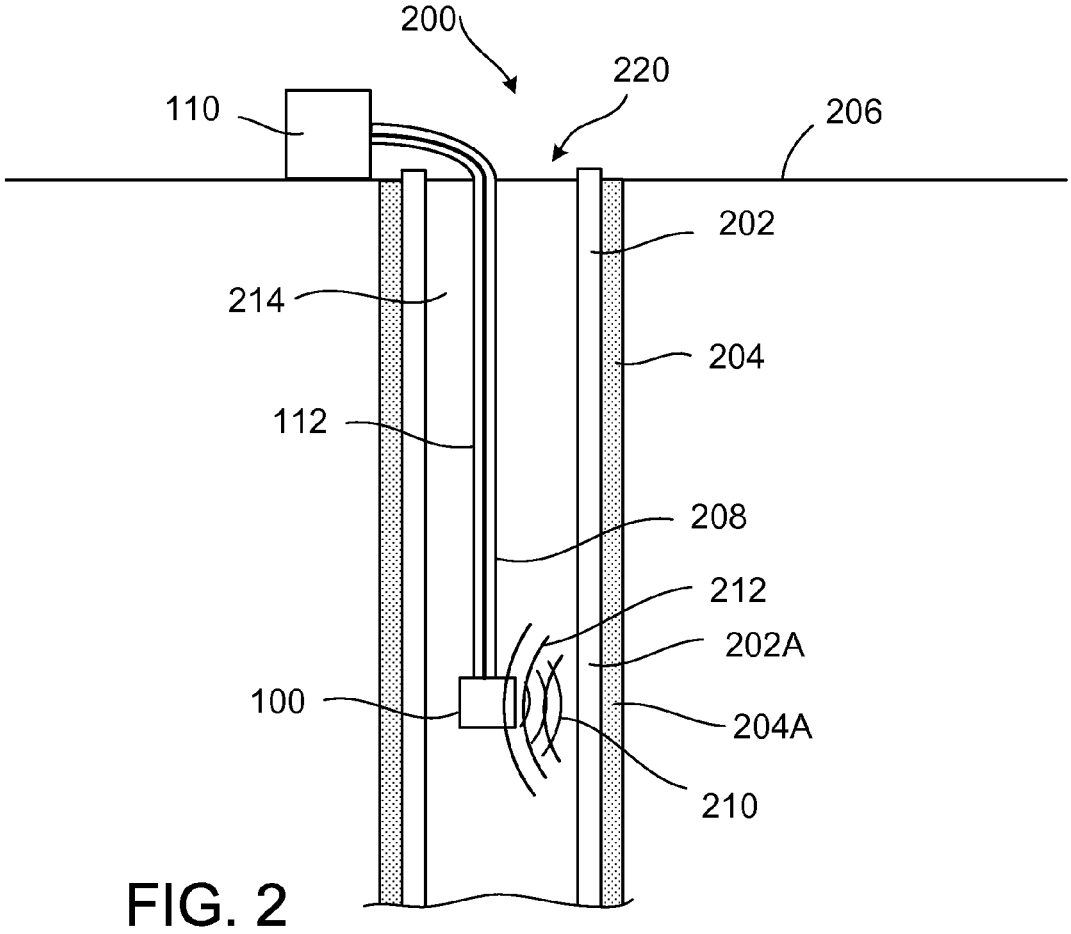
FIG. 2 shows a simplified schematic diagram of an embodiment of a monitoring system being used in a well structure.

Referring to FIG. 2, monitoring system 100 monitors the structures of an example well 200. Well 200 includes pipe casing 202 and cement support 204 disposed in a borehole 220 located below the surface of the earth 206. During an example monitoring process, an operator lowers monitoring system 100 within the interior of pipe casing 202, and oversees the monitoring process from the surface 206 using control station 110. Monitoring system 100 is suspended on the end of support cable 208, and is connected to control station 110 through a signal connector 112 that runs the length of support cable 208. In some implementations, signal connector 112 runs along an interior portion of support cable 308. In some implementations, signal connector 112 and support cable 208 are integrated, such that support cable 208 supports monitoring system 100 and connects system 100 to control station 110. During operation, transmitter 102 of monitoring system 100 directs time dependent driving pulse energy 210 radially towards pipe casing portion 202A and cement support portion 204A, and receiver 104 measures energy 212 that returns from portions 202A and 204A. Processing module 106 of monitoring system 100 amplifies, digitizes, and analyses the measurements of energy 212 to produce monitoring information regarding portions 202A and 204A. System 100 transmits the monitoring information and other information related to the monitoring process, including signal measurements and operational feedback, to control station 110. The operator interacts with control station 110 to review the monitoring information and other related information, and adjusts the operation of system 100 as desired. Operator commands are transmitted back to monitoring system 100 through signal connector 112.

Referring to FIGS. 1 and 2, transmitter 102 can be a transmitter capable of providing acoustic energy in a desired frequency range (e.g., 50-500 kHz) and at a sufficiently high amplitude under the conditions typically encountered in down well environments (e.g., at high temperatures, such as temperatures in excess of 170° C., and at high pressures, such as pressures greater than 20,000 Psi). For example, transmitter 102 may be an ultrasound transducer that is capable of providing acoustic energy at or above 20 kHz. Similarly, receiver 104 can be a receiver capable of detecting acoustic energy in the desired frequency range under the conditions typically encountered in down well environments. In general, the transmitter and receiver are made of piezoelectric materials. For example, in some embodiments the transmitter and receiver include piezoelectric elements that are made, in part, of lead-zirconate-titanate (commonly referred to as PZT) or lead magnesium niobate-lead titanate (commonly referred to as PMN-PT) ceramic materials. In some embodiments, the transmitter and the receiver may share the same piezoelectric element. In some embodiments, the transmitter and receiver may further include a highly attenuated block to support the piezoelectric element, in order to improve the transmitter and receiver response. This attenuated block may be made of various materials, for instance a tungsten and rubber composite. The attenuated block and the piezoelectric element may be encapsulated within an envelope, forming a completed transducer.

In general, the relative timing between transmitter 102 emitting acoustic energy and receiver 104 detecting acoustic energy may vary. In some embodiments, transmitter 102 and receiver 104 operate at the same time, such that transmitter 102 transmits energy and receiver 104 measures returning energy 212 simultaneously. In some embodiments, receiver 104 measures returning energy only after transmitter 102 has completed transmitting energy. In some embodiments, there may be a delay between transmitter 102 completing the transmission of energy, and the beginning of measurements by receiver 104. For example, in some embodiments, there may be a delay of approximately 0-50 μs.

Pipe casing 202 provides access to the underground locations, allows for materials in the ground to be transported to the surface, and varies in specification depending on its application and intended usage. For example, in instances where pipe casing 202 is used for the extraction of hydrocarbons from an underground location, the pipe casing 202 may extend up to approximately 30,000 feet or more below the surface, with a measured depth (or length along the well path) that may extend to 40,000 feet or beyond. Pipe casing 202 is generally tubular with a diameter that changes as a well progresses, and may have an outer diameter of approximately 4.5-26 inches, or larger, and a casing wall thickness of approximately 0.2-1.5 inches. Pipe casing 202 may be made of various materials. For example, pipe casing 202 can be constructed of steel or another other metal or metal alloy. During well evaluation, pipe casing 202 is generally filled with a borehole fluid 214, such as mud.

Cement support 204 encases the outer periphery of pipe casing 202, and provides additional structural support along the length of well 200. Cement support 204 may vary in thickness depending on its intended application and location, and may extend from the surface of pipe casing 202 to approximately 0.5 inches or more from the outer surface of pipe casing 202. Cement support 204 may be made various types of cement. For example, cement support 204 may be made of Portland cement mixed with various other substances, depending on the pressure and temperature conditions of a particular application. For instance, these substances may include strengthening agents or additives that help maintain the integrity of the cement with changing temperature and pressure. In some embodiments, nitrogen gases may be mixed into the cement in order to create a cement foam or slurry. The resulting material may have increased mobility and may improve bonding between the pipe casing and the cement formation.

In some embodiments, portions of system 100 may be located on the surface, such as within or in proximity to control station 110, or along a non-end portion of support cable 208. For example, power supply 108 may be located on the surface and in proximity to control station 110, and may supply power to system 100 through connector 112 or another connector that runs the length of support cable 208. In another example, processing module 106 may be located on support cable 208 but separated from the other components of system 100, such that operational signals, measurement signals, or power are relayed between transmitter 102, receiver 104, and power supply 108 through connector 112. In another example, processing module 106 may be located on or near the surface, and in proximity to control station 110. In these embodiments, operational signals, measurement signals, and/or power may be transmitted between transmitter 102, receiver 104, and power supply 108 through connector 112, or through another connector that runs the length of support cable 208. In some embodiments, system 100 stores raw or processed measurement signals for future retrieval by processing module 106, control station 110, or another data processing component. Signals may be stored using various storage devices, such as volatile or non-volatile media and memory devices.

In some embodiments, operational signals and measurement signals may be transmitted from processing module 106 to control station 110 through a wireless connection, either instead of or in addition to connector 112. Wireless connections may be implemented using various components, for example, communications modules that transmit and receive acoustic or electromagnetic signals.

In some embodiments, the entire system 100 may be located on a non-end portion of support cable 208, and a second tool, such as a drill module, may be placed at the end of support cable 208. In this manner, an operator may use system 100 to monitor pipe casing 202 and cement structure 204 during the digging of a wellbore and the construction of the well.

Figure 3B:
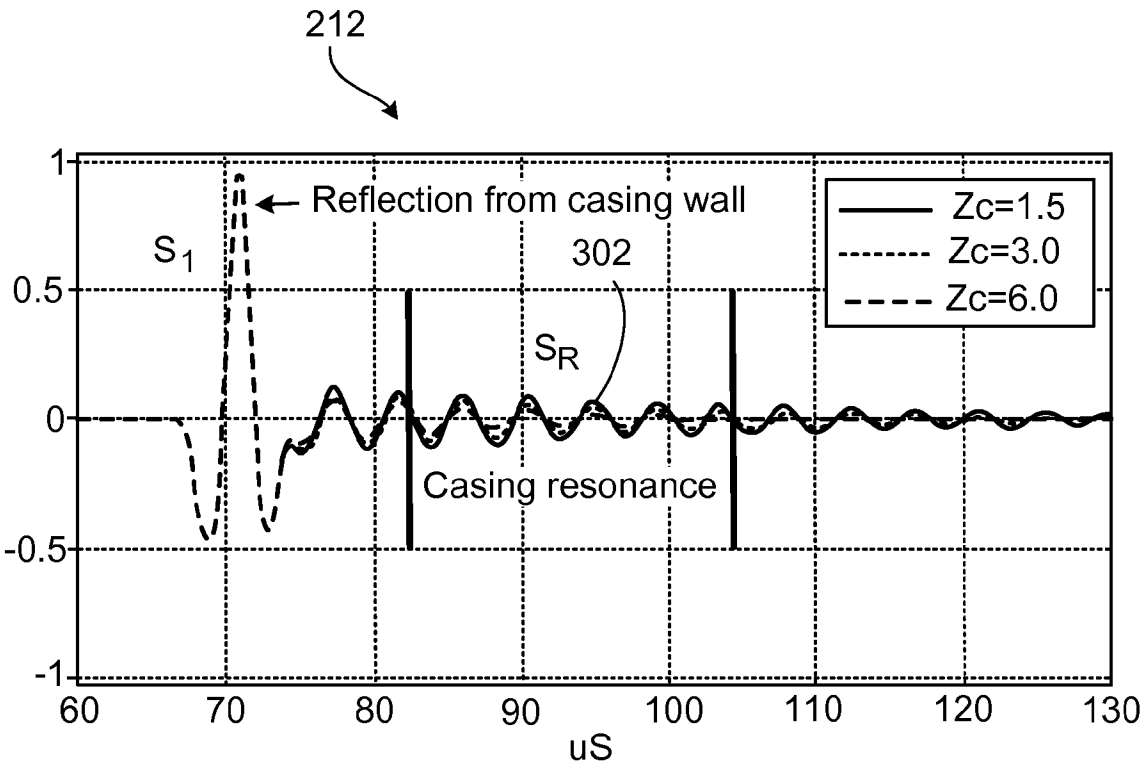
FIGS. 3A-B show the transmission of energy towards a well structure, and the return of energy from the well structure.
Figure 3A:
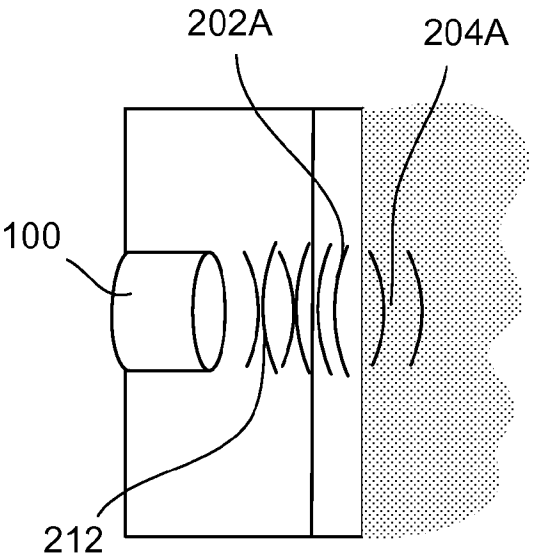

Referring to FIG. 3A, system 100 monitors casing portion 202A and cement portion 204A based on measurements of the returning time varying energy 212. In general, the ability of system 100 to monitor these structures depends on several factors, such as the composition of the structures of the well and of the surrounding environment, the thickness of these structures, and the penetration depth of the acoustic energy. In some embodiments, system 100 may also monitor rock formations that surround well 200. Referring to FIG. 3B, returning time varying energy 212 is an oscillatory waveform that includes several portions, notably the first reflection $S_1$ (one or more cycles that correspond to the first energy reflection from the inner surface of casing 202), and the casing resonance signal $S_R$, (one or more cycles that correspond to the energy resonating inside casing 202 caused by the resonance of multiple reflections inside casing 202). As $S_R$ is a gradually decaying oscillatory signal, the root mean square (RMS) peaks of one or more cycles (for instance, five cycles) of $S_R$ 302 may be used as an approximation for the amplitude behavior of $S_R$. As the amplitudes of $S_1$ and $S_R$ are each highly dependent on the impedances of casing 202 and the material behind casing 202, properties regarding the casing 202 and cement support 204 may be determined based on measurements of energy 212. For example, as illustrated in FIG. 3B, if the casing impedance is held constant, while the impedance of cement support 204 is varied between 1.5, 3, and 6 MRayls, the amplitude of first reflection $S_1$ remains largely the same, while the amplitudes of $S_R$ decrease as the material impedance increases. Thus in this case, the ratio between $S_1$ and $S_R$ provides insight regarding the material behind casing 202. In a similar manner, this ratio can provide information regarding the variation of casing thickness, the borehole fluid properties, the transmitter properties, as well as the properties of the driving pulses of energy 210.

Figure 4A:
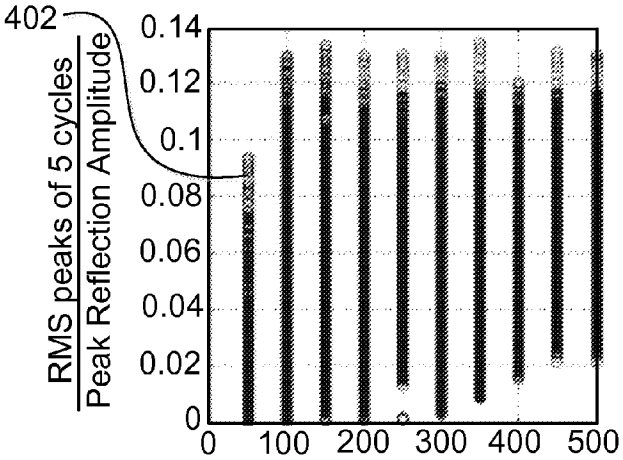
FIGS. 4A-D show the relationship between the peak amplitudes of a resonant signal and of a returning signal based on various factors.
Figure 4B:
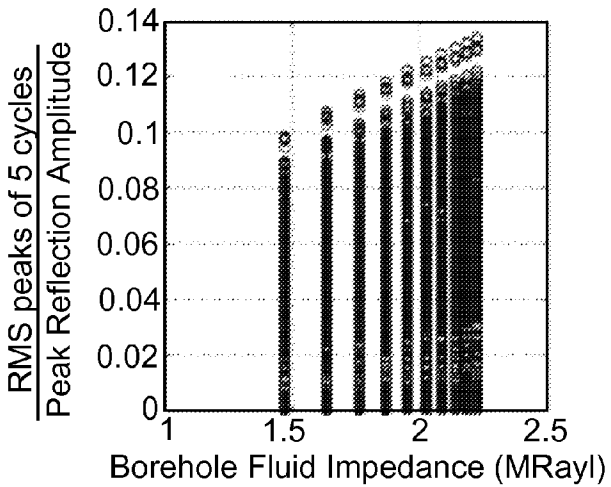
Figure 4C:
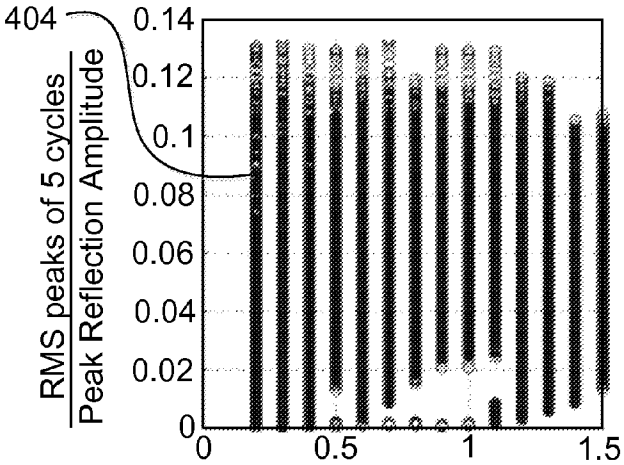
Figure 4D:
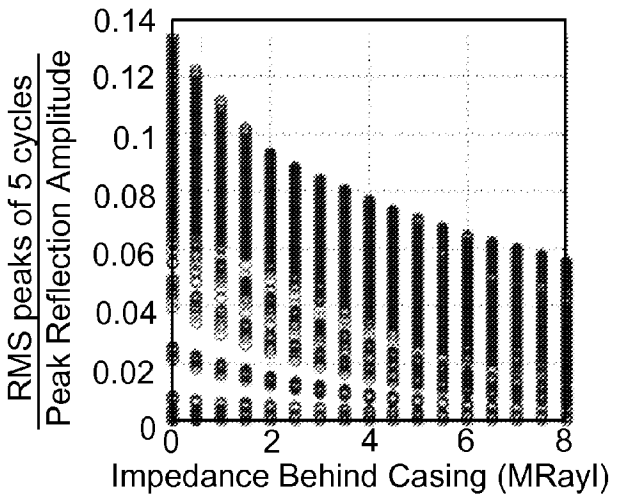

FIGS. 4A-D further illustrate the relationship between the RMS peaks of $S_R$, the peak amplitude of $S_1$, the frequency of the driving pulse energy 210, the impedance of the borehole fluid, the thickness of casing 202, and the impedance of material behind casing 202. This multi-dimensional relationship can be represented by a series of two-dimensional scatter plots (FIGS. 4A-D). In these figures, each individual scatter point represents a single ratio value (the RMS peaks of 5 cycles of $S_R$ over the peak amplitude of $S_1$), given a specific driving pulse frequency, a specific borehole fluid impedance, a specific casing thickness, and a specific impedance of the material behind the casing. Each cluster represents the range of possible ratio values given the specific parameter value of the y-axis, while the other parameters are varied over a range of values. For example, referring to FIG. 4A, cluster 402 represents the range of ratio values given a driving pulse energy of 50 kHz, where the impedance of the borehole fluid is varied between approximately 1.5-2.3 MRayl, the casing thickness is varied between approximately 0.2-1.5 inches, and the impedance of the material behind the casing is varied between approximately 0-8 MRayls. Similarly, referring to FIG. 4C, cluster 404 represents the range of ratios given a casing thickness of 0.2 inches, where the frequency of the driving pulse energy is varied between approximately 50-500 kHz, the impedance of the borehole fluid is varied between approximately 1.5-2.3 MRayl, and the impedance of the material behind the casing is varied between approximately 0-8 MRayls. Thus, we can visualize changes in the ratio values based on changes in the frequency of the driving pulse energy (FIG. 4A), changes in the impedance of the borehole fluid (FIG. 4B), changes in the thickness of the casing (FIG. 4C), and changes in the impedance of the material behind the casing (FIG. 4D).

Figure 5A:
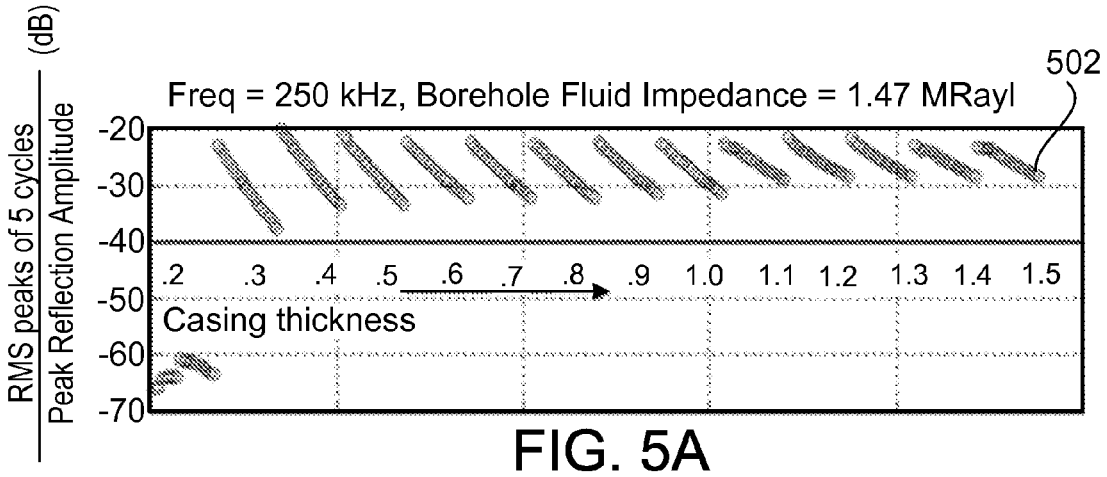
FIGS. 5A-C show the relationship between the peak amplitudes of a resonant signal and of a returning signal based on various factors.
Figure 5B:
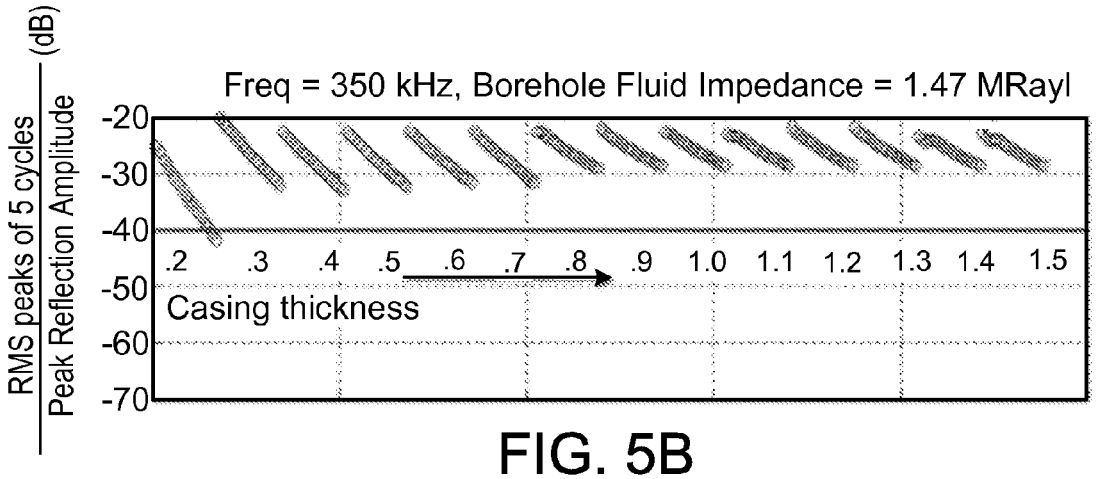
Figure 5C:
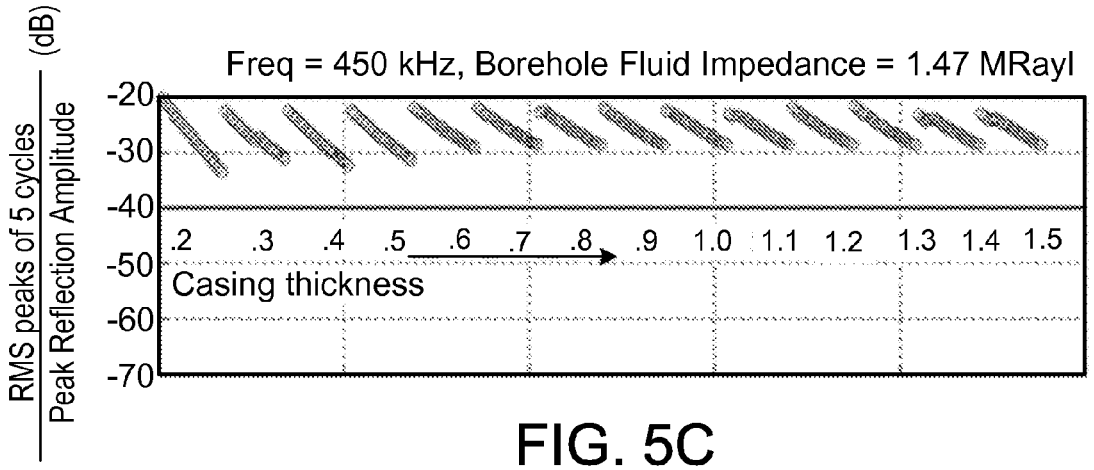

If values for one or more of the parameters are known, these scatter plots may be further simplified. For example, FIGS. 5A-5C illustrate how the ratio of the RMS peaks of five cycles of $S_R$ over the peak amplitude of $S_1$ changes with respect to the casing thickness and the impedance of the material behind the casing, if the impedance of the borehole fluid is known to be 1.47 MRayl, and the frequency of the driving pulse energy is known to be either 250 Hz (FIG. 5A), 350 kHz (FIG. 5B), or 450 kHz (FIG. 5C). In these figures, each cluster represents a ratio value for a specific casing thickness, while the impedance of the material behind the casing is varied. For example, cluster 502 represents the range of ratios given a casing thickness of 1.5 inches, where the frequency of the driving pulse energy is 250 kHz, the impedance of the borehole fluid is 1.47 MRayl, and the impedance of the material behind the casing is varied between approximately 0-8 MRayls. Thus, when one or more of the parameter values are known, the system can better estimate the values of the remaining unknown parameters.

As illustrated above, in a typical implementation of system 100 the peak amplitude of $S_1$ may range from approximately five to several hundred times the RMS peaks of five cycles of $S_R$. Due to this difference in amplitudes, system 100 can have a sufficiently large dynamic range to accurately amplify, digitize, and interpret the measurements of energy 212. This is made difficult due to the extreme environmental conditions common to a wellbore, which can reach depths of up to 40,000 feet below the surface, temperatures as high as 250° C., and pressures as high as 20,000 psi. In particular, these conditions are unsuitable for high dynamic range high frequency amplifiers that are needed to properly amplify the measurements of energy 212 prior to digitization.

Figure 6:
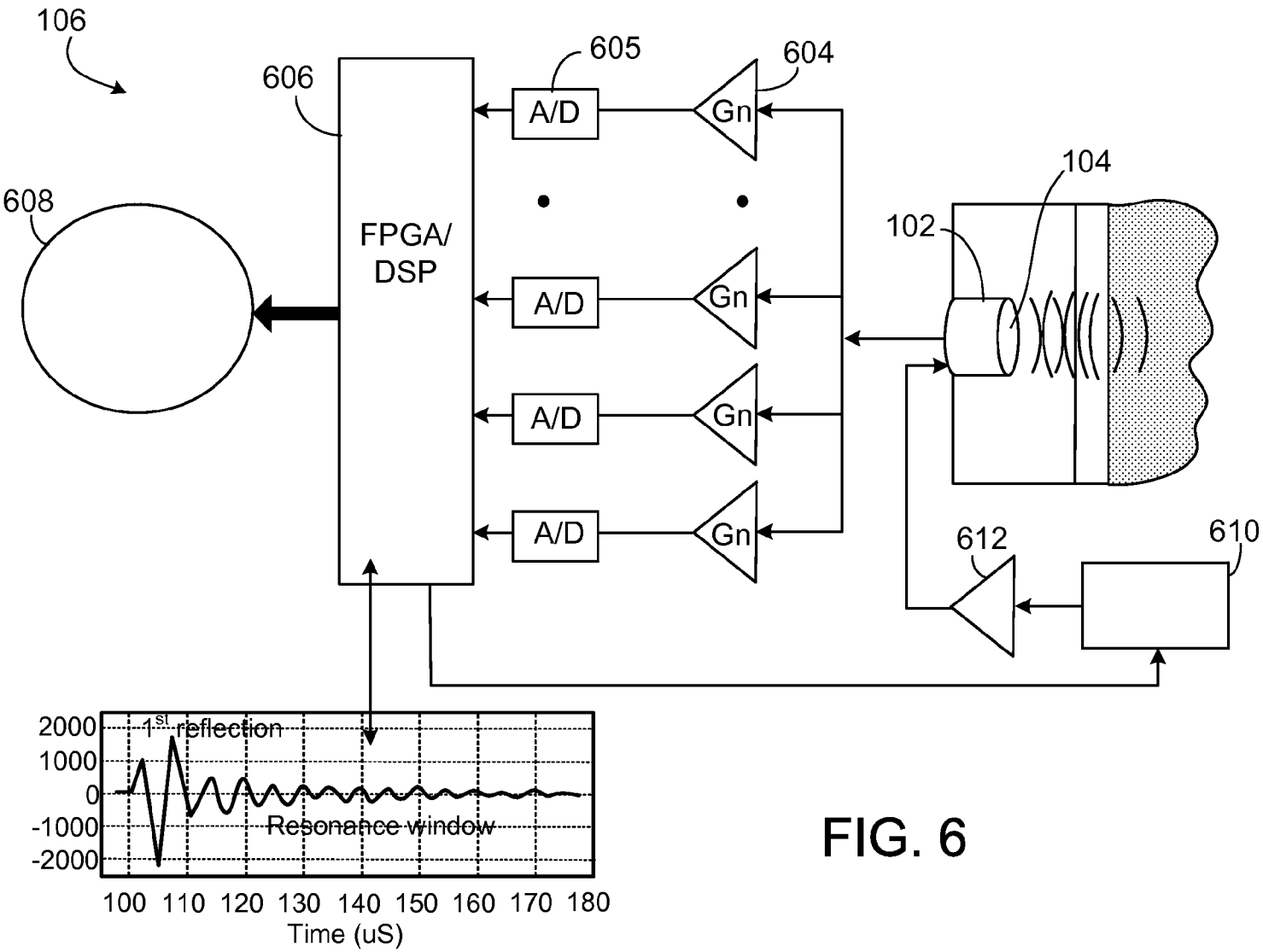
FIG. 6 shows a simplified schematic diagram of an embodiment of a monitoring system.

To overcome this limitation, processing module 106 may use a multi-amplifier design, an example of which is illustrated in FIG. 6. Here, processing module 106 includes an array of several amplifiers 604 arranged in parallel, each with a different fixed gain G1, G2, G3, . . . , Gn. As fixed gain amplifiers are generally considered to be more stable and less susceptible to failure in high temperature and high pressure environments, processing module 106 is less likely to fail compared to devices that include high dynamic range variable amplifiers. A high temperature and high pressure environment may be, for example, an environment with a temperature of 200° C. or higher and a pressure of 20,000 psi or higher.

The number of amplifiers, the gain of each individual amplifier, and the spacing of the gains of the amplifiers may be selected depending on the expected $S_R$ and $S_1$ values in a particular implementation. For example, in some embodiments, two or more amplifiers (e.g., two, three, four, five, six, seven, eight, nine, 10, 11, 12 or more) can be used that span of a desired gain range (e.g., from −100 dB or more to +100 dB or less, such as from −50 dB or more to 80 dB, such as from −20 dB to 60 dB, etc.).

In some implementations, driving pulse signals from pulse generator 610 are amplified by high voltage high frequency linear amplifier 612 and converted into acoustic energy by transmitter 102. This acoustic energy is directed by transmitter 102 towards the pipe casing (e.g. time dependent driving pulse energy 210 directed towards pipe casing 202). Receiver 104 measures the energy 212 that returns to system 100, then transmits measurements of energy 212 to an array of amplifiers 604.

Each amplifier 604 amplifies measurements of energy 212 to produce a respective differently amplified signal. Amplifiers 604 may simultaneously or nearly-simultaneously amplify the measurements of energy 212 in parallel to produce an array of differently amplified signals. Each amplified signal is then digitized by analog to digital converters (ADCs) 605, and transmitted to digital signal processor (DSP) 606. DSP 606 selects one or more of the amplified signals from ADCs 605, then produces monitoring information regarding the well based on these signals. DSP 606 may also transmit these signals to telemetry, memory and processing component 608. Telemetry, memory, and processing component 608 calculates the ratio between $S_R$ and $S_1$, transmits this information and other related operational data to control station 110, and stores this information other related data for future review. DSP 606 may also supply feedback to pulse generator 610 to adjust the operational parameters of pulse generator 610 in order to optimize the signal strength of the driving pulse energy. In some embodiments, DSP 606 adjusts the amplitude, frequency, or the waveform pattern of the signals generated by pulse generator 610. In general, the frequency of the resonance signal $S_R$ depends on the thickness of the casing 202, such that the energy of $S_R$ is higher at a particular resonance frequency and at the other harmonics of the resonance frequency. For example, the main resonance frequency of a one inch thick casing is approximately 114 kHz, and has high energy frequency components at 114, 228, 342, 456 and 570 kHz. If the center frequency of the driving pulse is one of these five resonance frequencies, the energy of $S_R$ would be significantly higher than that induced by a non-resonant frequency driving pulse. Therefore, DSP 606 may adjust the driving pulse frequency around one or more of the resonant harmonic frequencies for the next fired pulse. In addition, DSP 606 may adjust other parameters, either instead of or in addition to the frequency, for instance the driving pulse amplitude and shape.

In some embodiments, each amplifier 604 in the amplifier array has a fixed gain that is different than that of the other amplifiers 604, and the gain values for each are spread over a broad range such that the amplifier array encompasses a broad range of possible gains. Each amplifier has a bandwidth that encompasses at least the range of possible frequencies of the driving pulse energy, and each has an approximately flat or linear frequency response in the frequency range of the driving pulse energy. For example, in some embodiments, amplifier 604 has a band width of approximately 0 (DC) to 1 MHz, and has an approximately flat or linear amplification response region between approximately 50-500 kHz. The array of amplifiers may include any number of amplifiers 604 sufficient to span the desired range of gains. For example, in some embodiments, the array of amplifiers includes two or more amplifiers (e.g., two, three, four, five, six, seven, eight, or more amplifiers). The gain of each amplifier 604 may differ depending on the number of amplifiers in the array and the expected amplitude ranges of $S_1$ and $S_R$. For example, in some embodiments, amplifiers 604 may have gains between −20 dB to 60 dB. The distribution of amplifier gains may be linear, logarithmic, or otherwise distributed, and amplifiers gains may be concentrated in a pre-determined range. For example, in some embodiments, the gain of each amplifier differs by steps of 10 dB. In other embodiments, the gain of each amplifier by differ from the gain of the next lower amplifier by a factor of 2, 4, 8, or any other appropriate spacing. The output voltage of each amplifier may vary. In some embodiments, the maximum output signal voltage is ±2 V. In some embodiments, one or more amplifiers 604 may be a variable gain amplifier.

Pulse generator 610 may generate waveforms of varying patterns, pulse widths, and amplitudes. In some embodiments, pulse generator 610 generates a square pulse with a width of 0.1-20 μs and an amplitude of 400 V. In some embodiments, pulse generator produces other waveforms, such as a sinusoidal wave or an arbitrary pulse, and may be programmable to select between several different patterns and pulse parameters.

Amplifier 612 is a linear amplifier and operates within the range of pulse frequencies generated by pulse generator 610. In some embodiments, amplifier 612 has a dynamic range between 10 kHz to 1 MHz. In some embodiments, amplifier 612 has a linear gain of 0-60 dB, and a voltage output between 10-1000 V.

DSP 606 includes several signal channels, such that several amplified signals from amplifiers 604 may be processed simultaneously or nearly simultaneously. In some embodiments, DSP 606 includes at least as many signal channels as amplifiers 604, such that all of the amplified signals from amplifiers 604 may be processed simultaneously without the need for a separate switch or multiplexer. DSP 606 has a bit resolution sufficient to accurately and precisely measure the range of possible values from ADC 605. In some embodiments, DSP 606 has a bit resolution of at least 12 bits. DSP 606 has a sampling frequency sufficient to sample and record signals from ADCs 605. In some embodiments, DSP 606 has a sampling rate of at least 5 MHz, and a recording time of at least 500 μs. ADCs 605 have a similar bit resolution as DSP 606. In some example embodiments, ADCs 605 have a bit resolution of 12 bits.

Figure 7:
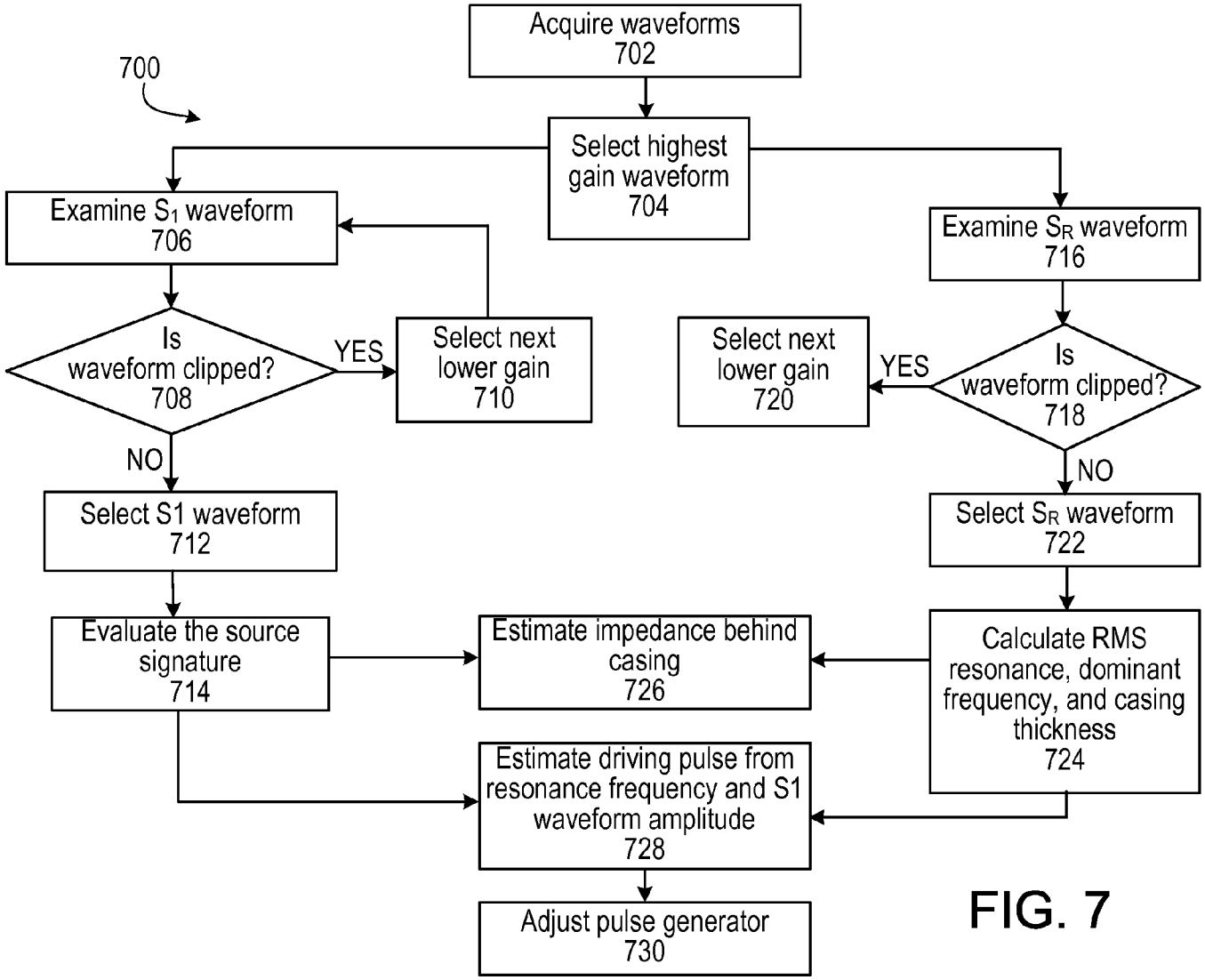
FIG. 7 shows an example process of selecting one or more amplified signals.

DSP 606 selects one or more of the amplified signals based on selection process 700, an example embodiment of which is illustrated in FIG. 7. DSP 606 acquires several differently amplified waveforms from the array of amplifiers 604 (block 702), then selects the waveform with the highest gain (block 704).

Figure 8A:
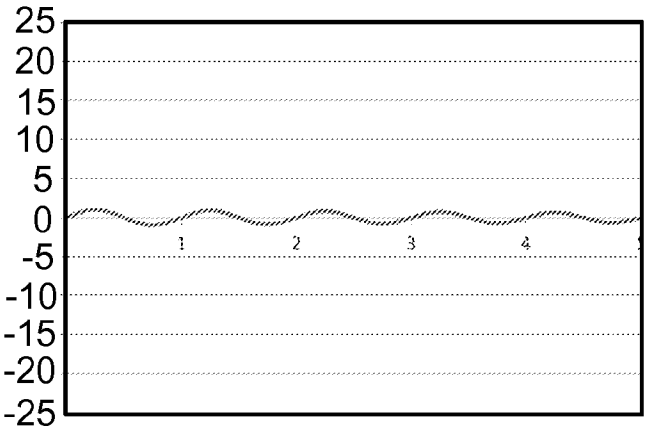
FIGS. 8A-D show examples of amplified signals.
Figure 8B:
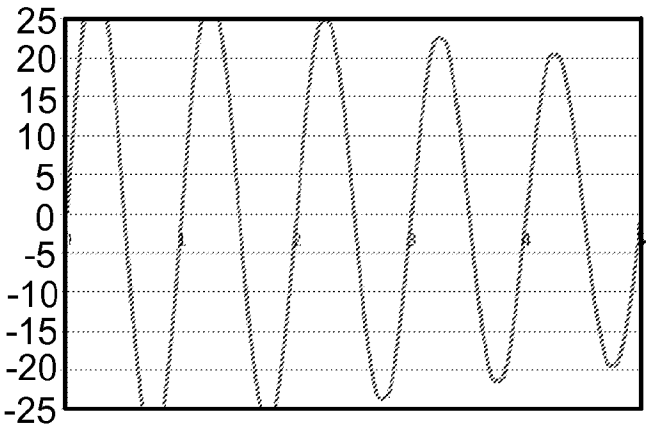
Figure 8C:
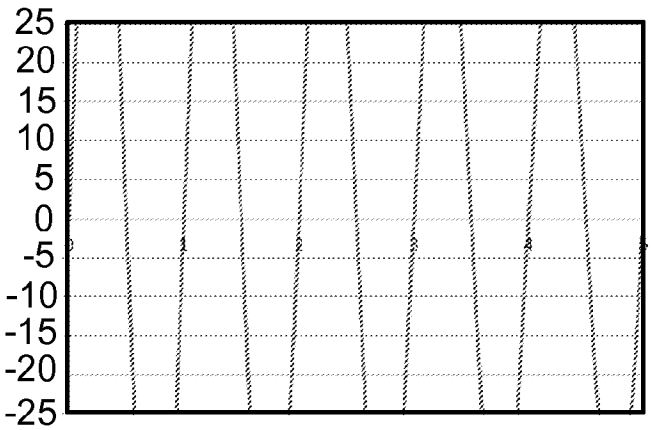
Figure 8D:
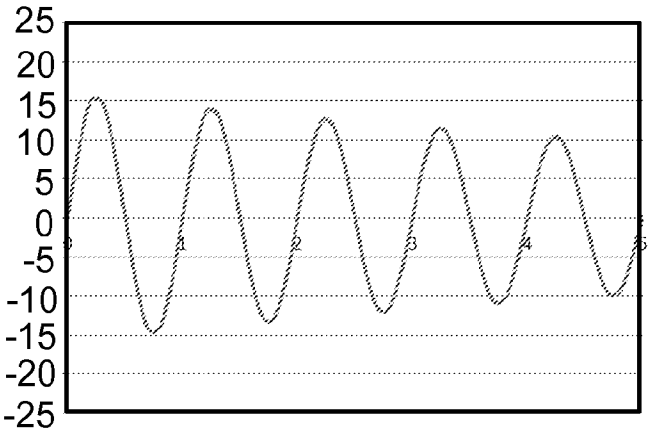

DSP 606 examines the $S_1$ component of the waveform (block 706), and determines if the $S_1$ component is clipped (block 708). Clipping may be determined using various ways. For example, a clipped waveform may have a discontinuous region, a region where the waveform exceeds or drops below a predefined value, a plateau region where the waveform remains at an extreme high or low constant value, or an $S_1$ component that does not have the expected characteristic oscillatory shape. Examples of clipped waveforms are illustrated in FIG. 8, where a waveform (FIG. 8A) is amplified using various different gains. FIG. 8B and 8C illustrate amplified waveforms that are clipped, as the waveform exceeds predefined window values, and contains multiple discontinuities. FIG. 8D illustrates an amplified waveform that is not clipped.

If the selected waveform has a clipped $S_1$ component, DSP 606 selects the waveform with the next lower gain (block 710), and repeats the check for clipping (blocks 706 and 708). If the selected waveform does not have a clipped $S_1$ component, DSP selects the waveform as the $S_1$ waveform (block 712). In this manner, system 100 fully utilizes the bit resolutions of DSP 606 and ADCs 605 to improve accuracy and precision, while avoiding clipping artifacts that may otherwise negatively affect the monitoring process.

After selecting the appropriate $S_1$ waveform, system 100 evaluates the source signature of the selected waveform (block 714). For example, this may include determining the maximum amplitude of the waveform, determining the center frequency of the waveform, determining the characteristic $S_1$ shape, or determining other information regarding the waveform.

This process is similarly performed in parallel for the $S_R$ waveform. DSP 606 examines the $S_R$ component of the highest gain waveform (block 716), and determines if the $S_R$ component is clipped (block 718). In some embodiments, the DSP 606 considers only a portion of the $S_R$ component. For instance, DSP 606 may consider only five cycles of the $S_R$ component. In some embodiments, DSP 606 considers only the first several cycles of the $S_R$ component. In other embodiments, DSP 606 may considers other cycles of the $S_R$ component, for example the second through the sixth cycles, the third through the seventh cycles, or any other window of cycles. If the selected waveform has a clipped $S_R$ component, DSP 606 selects the waveform with the next lower gain (block 720), and repeats the check for clipping (blocks 716 and 718). If the selected waveform does not have a clipped $S_R$ component, DSP selects the waveform as the $S_R$ waveform (block 722).

After selecting the appropriate $S_R$ waveform, system 100 calculates the RMS resonance and the dominant frequency, and uses this information to determine the casing thickness (block 724). In some embodiments, RMS resonance may be calculated based a portion of all of the resonance waveform, for instance five cycles of the resonance portion of the waveform. The dominant frequency may be determined in various ways, for instance by measuring the time between the peak amplitudes of the resonance waveform, by examining the waveform in the frequency domain to determine the most prominent frequency components, or by other methods. Using this information, system 100 may then estimate the pipe casing thickness from the resonance signal. For instance, the frequency components of the resonance signal typically correspond to the thickness of the pipe casing. For example, for a one inch thick pipe casing, the frequency components of the resonance signal typically share a common multiple of approximately 114 kHz, and have harmonic frequency components at 114, 228, 342, 456, 570 kHz, etc. Thus, system 100 may estimate the casing thickness by determining a frequency multiple common to the multiple harmonic resonance frequency peaks. This calculation may also be based on additional information, for example known or estimated impendence values for the pipe casing, borehole fluid, and support structures, known or estimated dimensions of various other structures in the well, the driving pulse frequency, or other values. In some embodiments, one or more of the values may be assumed based on empirically determined values. For instance, the impedance values of the borehole fluid may be estimated prior to the use of system 100, and may be used by DSP 606 during operation.

After DSP 606 evaluates the source signature of the $S_1$ waveform (block 714) and calculates the RMS resonance and the dominant frequency of the $S_R$ waveform (block 724), DSP 606 estimates the impedance behind the casing (block 726). This estimate may also be based on several assumptions or measured values. For instance, the impedance behind the casing may be estimated based on known values for the borehole fluid impedance, case thickness, and driving pulse frequency. In some embodiments, one or more of the values may be also assumed based on empirically determined values.

Figure 9A:
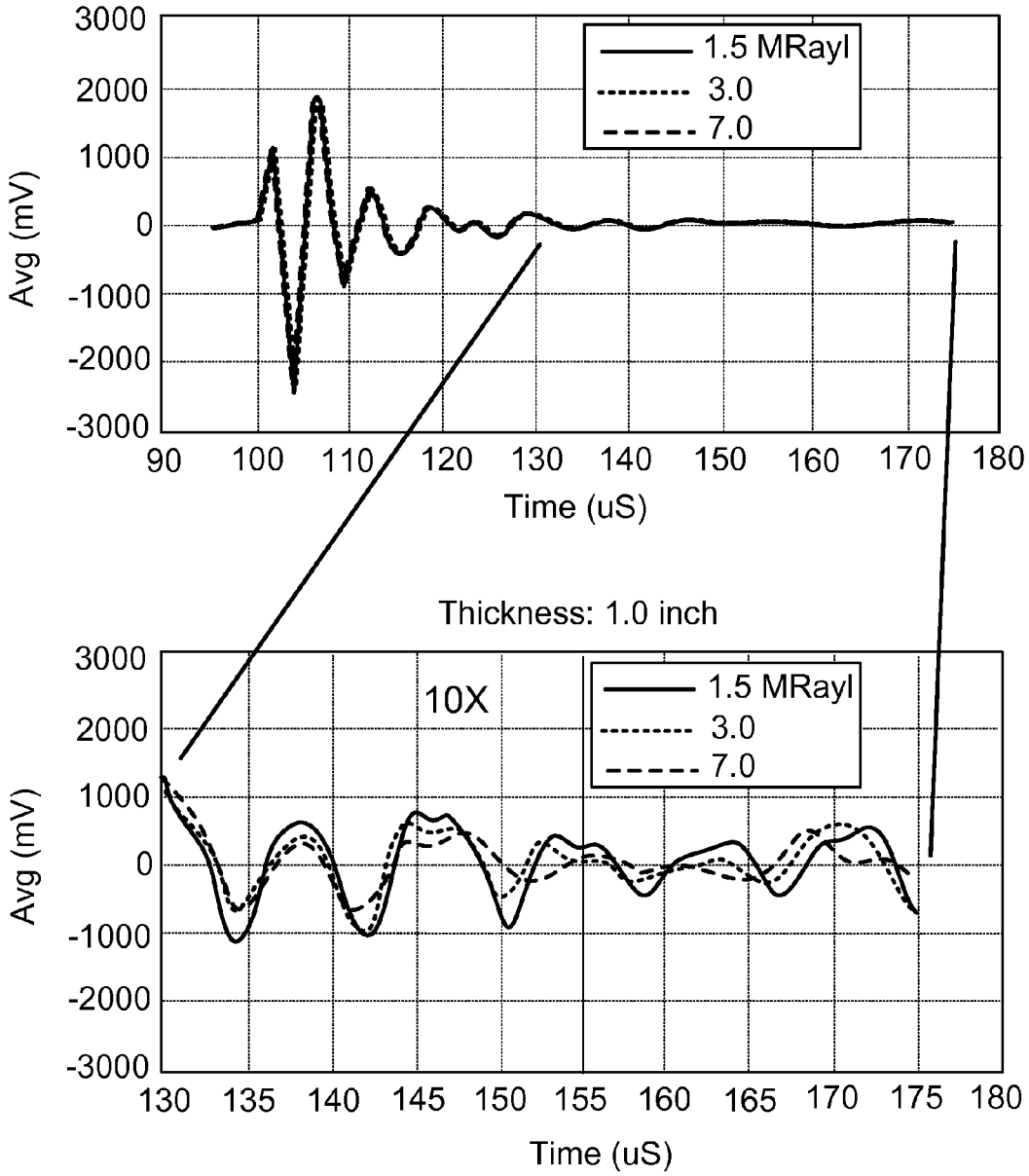
FIGS. 9A-C show example signals based on various characteristics of the well and its surrounding environment.
Figure 9B:
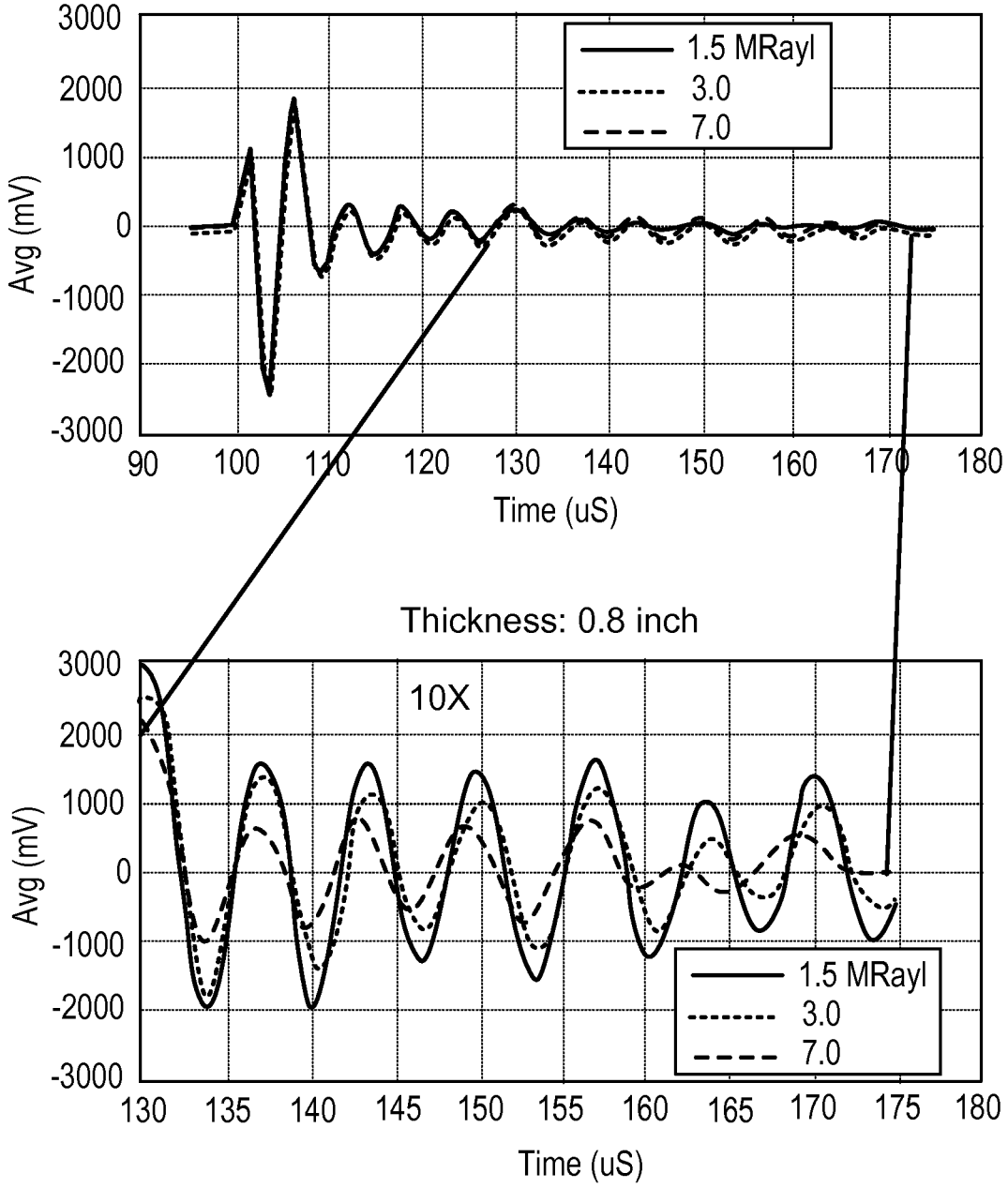
Figure 9C:
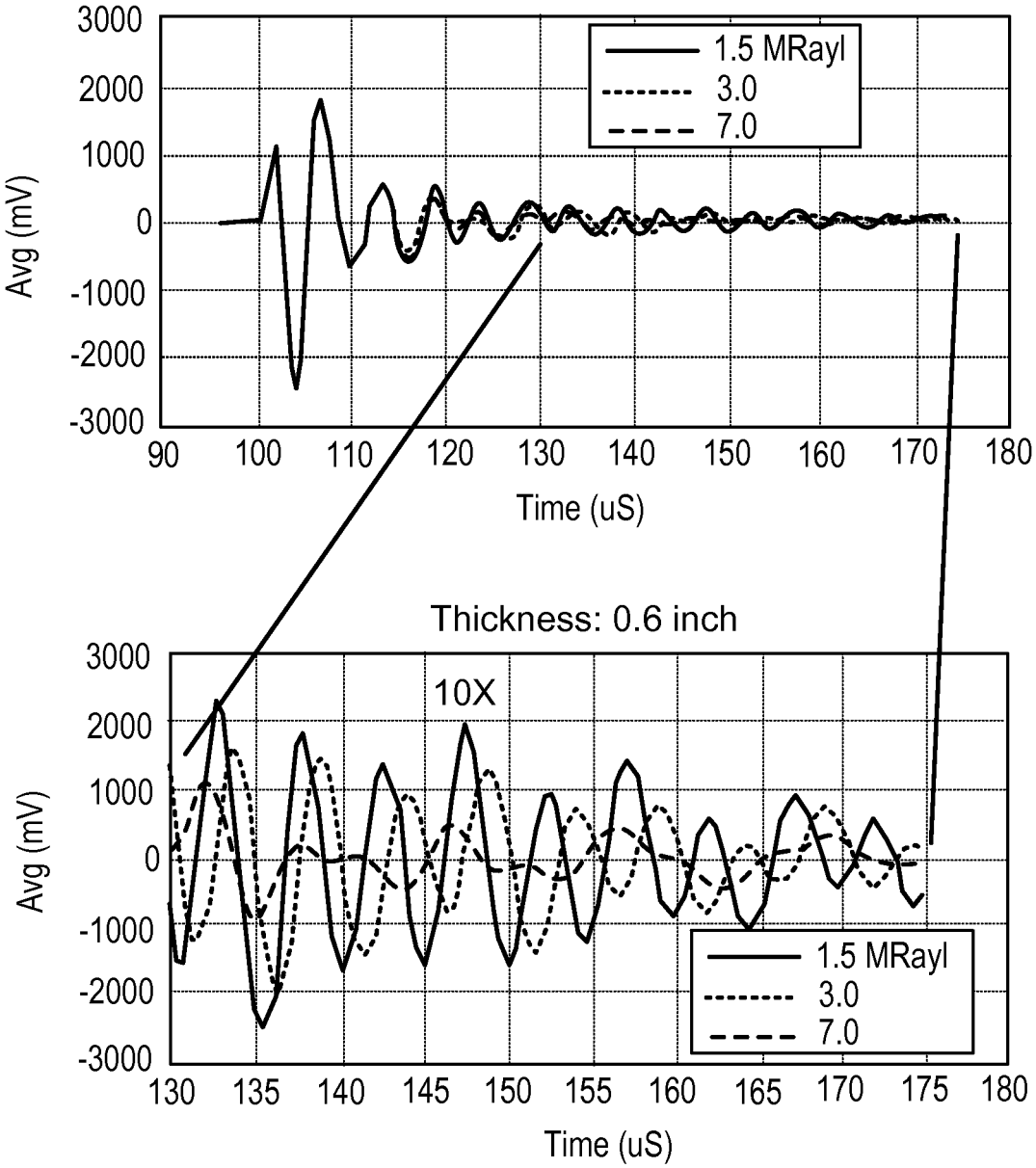

DSP 606 also estimates properties of the driving pulse energy 210 based on its determination of the resonance frequency and $S_1$ waveform amplitude (block 728). Using the information, DSP 606 adjusts the operational parameters pulse generator in order to optimize the signal strength of the driving pulse energy (block 730). For example, if the pipe casing is not of the expected thickness (for instance due to erosion damage or a construction error), the first reflection signal $S_1$ and resonance signal $S_R$ may deviate from their expected values, resulting in degradation of the observed signals. DSP 606 estimates the deviation of the resonance frequencies and the amplitude and adjusts the driving pulse frequency, shape, and amplitude to obtain optimal results. In some embodiments, system 100 may be used to monitor both the pipe casing and the material behind the pipe casing, for instance to determine the thickness of the casing and the composition of the material beyond this casing, as illustrated in FIG. 9. For example, system 100 may differentiate between 1 inch (FIG. 9A), 0.8 inch (FIG. 9B), and 0.6 inch (FIG. 9C) thick pipe casings based on the detected waveforms. Similarly, system 100 may differentiate between various materials behind the casing, for instance water (solid lines), which as a typical impedance of 1.5 MRayl, a light cement (dotted lines), which has a typical impedance of 3.0 MRayl, and a heavy cement (dashed lines), which has a typical impedance of about 7.0 MRayl. As each combination of casing thickness and material composition results in particular $S_1$ and $S_R$ waveforms, and thus a particular frequency of $S_R$ and a particular ratio between the RMS peaks of 5 cycles of $S_R$ (inserted graphs) over the peak amplitude of $S_1$, system 100 may use the detected waveforms to provide information regarding both the casing and the materials behind the casing.

In a similar manner, system 100 may be used to ascertain the integrity of pipe casing and its surrounding pipe structure, in order to locate and identify points of structural failure. For example, system 100 may determine regions where the casing or concrete supports are unexpectedly thin, then identify these anomalous regions as points of potential structural failure. In another example, system 100 may determine regions where the casing or concrete supports have impedance values different than that expected from a specific material, which may suggest, for example, a degradation of a material or a flaw that may have been introduced during construction.

Thus, system 100 may be used to accurately determine the materials, thickness, and integrity of a pipe casing and its surrounding support structures.

The techniques described above can be implemented in digital electronic circuitry, or in computer software, firmware, or hardware, including the structures disclosed in this specification and their structural equivalents, or in combinations of one or more of them. For example, certain signal processing techniques can be implemented as one or more computer programs, i.e., one or more modules of computer program instructions, encoded on computer storage medium for execution by, or to control the operation of, a processing module. Alternatively or in addition, the program instructions can be encoded on an artificially generated propagated signal, e.g., a machine-generated electrical, optical, or electromagnetic signal that is generated to encode information for transmission to suitable receiver apparatus for execution by a processing module. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

Certain operations described in this specification can be implemented as operations performed by a processing apparatus on data stored on one or more computer-readable storage devices or received from other sources. For example, these operations may include operations performed by DSP 606 (e.g. one or more steps of selection process 700), operations performed by telemetry, memory, and processing component 608 (e.g. calculating the ratio between $S_R$ and $S_1$, transmitting information to control station 110, and storing information for future review), or operations performed by control system 110 (e.g. presenting monitoring information to a user and adjusting the operation of system 100 in response to a user's commands).

The term "processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other module suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Certain processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. For example, control station 110 can be implemented on a computer having one or more display devices for displaying information to a user, and one or more keyboards and/or pointing devices. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described components and systems can generally be integrated together in a single product or packaged into multiple products.

A number of embodiments of the invention have been described. Nevertheless, it will be understood that other implementations are possible. For instance, in some embodiments, monitoring system 100 may be used to monitor any pipe-like structure, not just a well. For example, monitoring system 100 may monitor a pipe network for transporting a liquid or gel. In some embodiments, monitoring system may be used to monitor structures that are not underground, for instance structures that are located on the surface, underwater, or above ground. Accordingly, other embodiments are within the scope of the following claims.

What is claimed is:

1. A method for monitoring a well, the method comprising:

directing acoustic energy towards a pipe casing included in the well;

obtaining a measurement waveform by detecting acoustic energy returning from the pipe casing, the measurement waveform comprising a first portion and a second portion, the first portion corresponding to acoustic energy reflected from the pipe casing and the second portion corresponding to acoustic energy resonating in the pipe casing;

amplifying the measurement waveform by two or more different gains in parallel to produce respective differently amplified waveforms;

selecting a first amplified waveform from the two or more differently amplified waveforms based on a portion of at least one of the amplified waveforms corresponding to the first portion of the measurement waveform, selecting a second amplified waveform from the two or more differently amplified waveforms based on a portion of at least one of the amplified waveforms corresponding to the second portion of the measurement waveform, determining information about the well based on the first and second amplified waveforms, and determining if any of the portions of the amplified waveforms exceed a pre-determined value;

wherein the first and the second amplified waveforms are selected based on a determination whether any of the portions of the amplified waveforms corresponding to the first or the second portions of the measurement waveform of the differently amplified waveforms exceed the pre-determined value.

2. The method of claim 1, wherein the measurement waveform comprises an oscillatory waveform and the first portion comprises at least one cycle of the oscillatory waveform.

3. The method of claim 2, wherein the second portion comprises at least one cycle of the oscillatory waveform.

4. The method of claim 1, wherein the information about the well comprises information about the pipe casing or information about a material behind the pipe casing.

5. The method of claim 4, wherein the information about the pipe casing comprises an impedance value of the pipe casing.

6. The method of claim 4, wherein the information about the pipe casing comprises information about an integrity of the pipe casing.

7. The method of claim 4, wherein the information about the pipe casing comprises a thickness of the pipe casing.

8. The method of claim 4, wherein the information about the material behind the pipe casing comprises an impedance value of a material behind the pipe casing.

9. The method of claim 4, wherein the information about the material behind the pipe casing comprises information about an integrity of the material behind the pipe casing.

10. The method of claim 1, further comprising estimating properties of the acoustic energy based on the measurement waveform.

11. The method of claim 10, further comprising varying the frequency of the acoustic energy based on the measurement waveform.

12. The method of claim 1, wherein the information about the well comprises information about an integrity of a material around the pipe casing.

13. A system for monitoring a well comprising:

a pipe casing disposed in a well;

a transmitter positioned within the pipe casing to direct acoustic energy towards the pipe casing, a receiver positioned within the pipe casing to obtain a measurement waveform by detecting acoustic energy returning from the pipe casing, the measurement waveform comprising a first portion and a second portion, the first portion corresponding to acoustic energy reflected from the pipe casing and the second portion corresponding to acoustic energy resonating in the pipe casing;

a processing module comprising:

two or more waveform amplifiers in parallel, each waveform amplifier having a different gain; and a processor coupled to a memory;

wherein the memory stores a program that, when executed by the processor, causes the processing module to:

receive the measurement waveform from the receiver; amplify the measurement waveform using the two or more amplifiers in parallel to produce two or more corresponding differently amplified waveforms;

select a first amplified waveform from the two or more differently amplified waveforms based on a portion of at least one of the amplified waveforms corresponding to the first portion of the measurement sign, select a second amplified waveform from the two or more differently amplified waveforms based on a portion of at least one of the amplified waveforms corresponding to the second portion of the measurement waveform, determine information about the well based on the first and second amplified waveforms; and wherein the processing module is provided to determine if any of the portions of the amplified waveforms corresponding to the first or the second portions of the measurement waveform of the differently amplified waveforms exceed a pre-determined value;

wherein the processing module is provided to select the first and the second amplified waveforms based on its determination whether any of the portions of the amplified waveforms corresponding to the first or the second portions of the measurement waveform of the differently amplified waveforms exceed the pre-determined value.

14. The system of claim 13, wherein the transmitter comprises an ultrasound transducer.

* * * * *